US008438974B2

(12) United States Patent
Stull et al.

(10) Patent No.: US 8,438,974 B2
(45) Date of Patent: May 14, 2013

(54) ELECTROHYDRAULIC PRESSING DEVICE HAVING REMOVABLE HOSE

(75) Inventors: David Michael Stull, Etters, PA (US); David Alan College, Annville, PA (US); David Joseph Erb, Harrisburg, PA (US); Matthew Steven Houser, Jonestown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 494 days.

(21) Appl. No.: 12/263,898

(22) Filed: Nov. 3, 2008

(65) Prior Publication Data

US 2010/0107905 A1 May 6, 2010

(51) Int. Cl.
*B30B 1/32* (2006.01)
*B30B 15/00* (2006.01)

(52) U.S. Cl.
USPC ..... 100/269.14; 100/102; 100/269.17

(58) Field of Classification Search ..... 100/102, 100/103, 269.01, 269.15, 269.17, 269.18, 100/266; 72/453.01, 453.14, 453.15, 453.16, 72/453.17, 453.18, 453.19; 29/252, 275; 173/13, 173/17, 170
See application file for complete search history.

(56) References Cited

U.S. PATENT DOCUMENTS

| | | | | |
|---|---|---|---|---|
| 5,134,776 | A * | 8/1992 | Moody | 30/187 |
| 5,348,125 | A * | 9/1994 | Stribling | 191/12.2 R |
| D383,142 | S | 9/1997 | Juhlin | |
| D383,655 | S | 9/1997 | Juhlin et al. | |
| 5,687,567 | A | 11/1997 | Hansson et al. | |
| 5,730,022 | A | 3/1998 | Hansson et al. | |
| 5,848,879 | A | 12/1998 | Hansson | |
| 6,000,680 | A * | 12/1999 | Kimura et al. | 254/93 R |
| 6,641,011 | B1 * | 11/2003 | Kahn | 224/269 |
| 6,718,870 | B1 | 4/2004 | Frenken | |
| 7,254,982 | B2 | 8/2007 | Frenken | |
| 2006/0272381 | A1 | 12/2006 | Ayer et al. | |

FOREIGN PATENT DOCUMENTS

JP 2005 201285 A 7/2005

OTHER PUBLICATIONS

European Search Report, Mail Date, Apr. 27, 2012, EP 09 17 4816, Application No. 09174816.0-1252 / 2181807.

* cited by examiner

*Primary Examiner* — Jimmy T Nguyen

(57) ABSTRACT

A pressing device includes a work head having a work head body holding a tool and a mating end. The pressing device includes an actuator having an actuator body holding a hydraulic pump that is operable to drive the tool. The actuator has a mating end. The pressing device includes an interconnect assembly including a hydraulic hose having first and second couplings at both ends of the hydraulic hose for mating with the mating ends of the actuator and the work head, respectively. The interconnect assembly is removable and the work head is configured to be directly coupled to the actuator.

21 Claims, 5 Drawing Sheets

ELECTROHYDRAULIC PRESSING DEVICE HAVING REMOVABLE HOSE

BACKGROUND OF THE INVENTION

The subject matter herein relates generally to electrohydraulic pressing devices, and more particularly, to pressing devices having a removable hose such that a work head may be directly coupled to an actuator.

Electrohydraulic pressing devices are employed in numerous applications to provide a user with a desired mechanical advantage. One example application is in crimping tools used for making crimping connections, such as crimping terminals onto conductors. Another example application is in cutting tools where hydraulic power enables the user to apply a relatively large amount of force or pressure. In enabling such operations, it is generally desirable to provide a tool that can perform the desired operations, and is manageable as well. The pressing devices typically include a work head having tooling appropriate for the particular application, and an actuator coupled to the work head for driving the tooling. For example, the work head typically includes a fixed component and movable component that is hydraulically driven towards the fixed component, or two moving components that are driven toward each other, to perform an operation. The actuator includes a hydraulic pump that is operated to either directly or indirectly drive the movable component of the work head.

Known electrohydraulic pressing devices are not without disadvantages. For instance, it is often desirable that the pressing device be handheld and relatively portable. Conventional pressing devices are generally heavy and cumbersome to handle due to the relatively heavy electric power supply and/or hydraulic pump of the actuator which are contained within a housing of the actuator. Two main types of electrohydraulic pressing devices are known, one having the work head and actuator as part of a single unit with the power supply and hydraulic pump at one end of the unit and the work head at the opposite end of the unit. Due to the weight of the single unit design, such pressing devices are typically a two-hand device or may lead to fatigue of the operator quickly. The other type of known electrohydraulic pressing device has the work head and the actuator as separate pieces coupled together by a hydraulic hose. The work head can be carried by the operator in one hand and the operator's other hand may be free. The heavier actuator may be either set on the ground next to the operator or may be held by the operator such as by a strap or on a belt worn by the operator. While such two-piece pressing devices may be easier for the operator to handle in certain situations, such pressing devices may also be cumbersome for the operator to handle. For example, the hydraulic hose may be difficult to maneuver and/or fit into certain spaces. Additionally, the hydraulic hose adds weight to the overall pressing device.

As such, a need remains for a pressing device that may be robust and easy to use. A need remains for a pressing device that is manageable and capable of being used in many situations.

BRIEF DESCRIPTION OF THE INVENTION

In one embodiment, a pressing device is provided that includes a work head having a work head body having a mating end and holding a tool at the end opposite to the mating end. The pressing device includes an actuator having an actuator body holding a hydraulic pump that is operable to drive the tool. The actuator has a mating end. The pressing device includes an interconnect assembly including a hydraulic hose having first and second couplings at both ends of the hydraulic hose for mating with the mating ends of the actuator and the work head, respectively. The interconnect assembly is removable and the work head is configured to be directly coupled to the actuator.

In another embodiment, a pressing device is provided that includes a work head having a work head body holding a tool. The work head has a work head piston within the work head body for driving the tool, and the work head has a mating end. The pressing device includes an actuator having an actuator body holding a hydraulic pump being operatively coupled to a power source. The actuator body has a chamber receiving hydraulic fluid from the hydraulic pump and an actuator piston received in the chamber. The actuator piston is driven by the hydraulic fluid in the chamber. The actuator has a mating end. An interconnect assembly including a hydraulic hose having first and second couplings at both ends is provided for mating with the mating ends of the actuator and the work head, respectively. Each coupling has a captured piston and hydraulic fluid is filled between the captured pistons. The actuator piston drives the captured piston in the first coupling and the captured piston in the second coupling drives the work head piston. The interconnect assembly is removable and the work head is configured to be directly coupled to the actuator such that the actuator piston drives the work head piston.

In a further embodiment, a work head is provided including a work head body having a mating end and a head end. The work head body has a chamber and a work head piston is received in the chamber. The work head has a port at the mating end. The work head also includes a tool at the head end of the work head body and the tool has first and second toolings at least one of the first and second tooling being driven by an actuator. The mating end of the work head body may be used in a first coupling configuration in which the work head body is directly coupled to an actuator that is operated to drive the work head piston and the work head body may be used in a second coupling configuration in which the work head body is indirectly coupled to the actuator by a removable interconnect assembly.

In another embodiment, a pressing device is provided that includes a work head, an actuator including a hydraulic pump and a flexible conduit extending between the work head and the actuator for transferring hydraulic pressure generated by the hydraulic pump to the work head. The actuator includes a mounting element configured to be mounted to a user's hip.

DETAILED DESCRIPTION OF THE INVENTION

Figure 1:
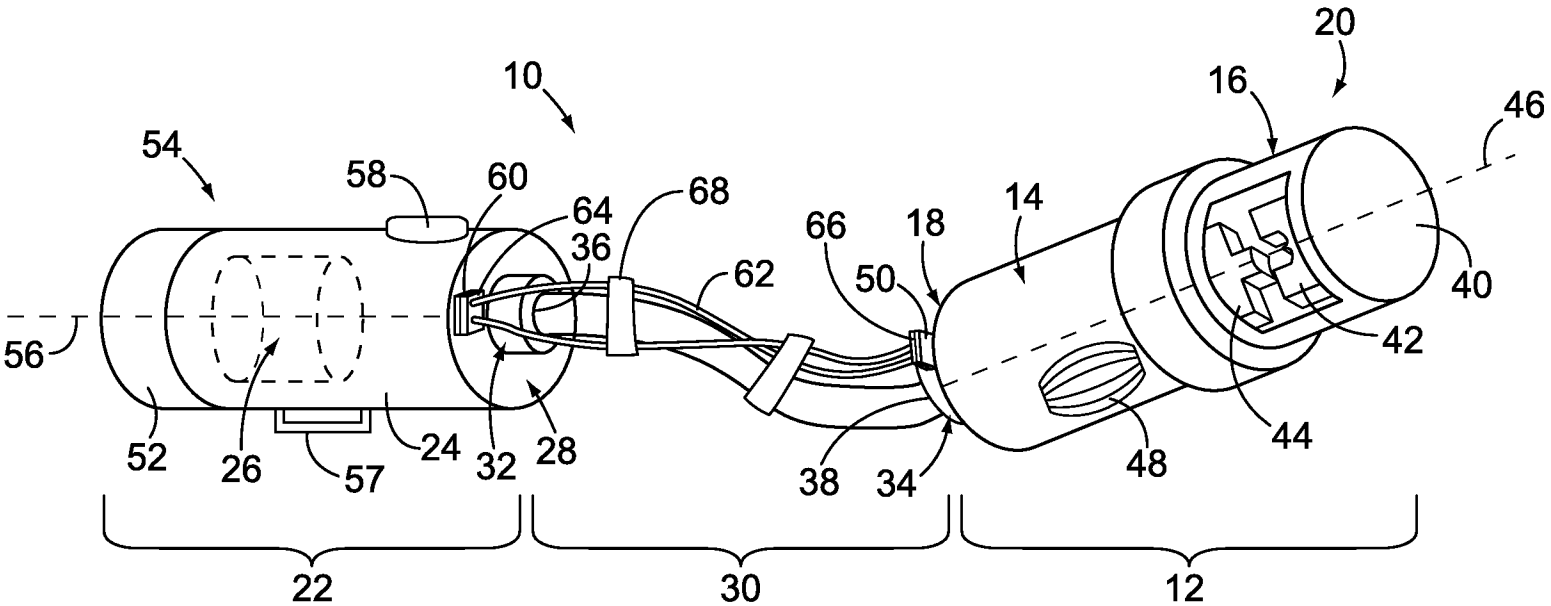
FIG. 1 illustrates an electrohydraulic pressing device formed in accordance with an exemplary embodiment.

FIG. 1 illustrates an electrohydraulic pressing device 10 formed in accordance with an exemplary embodiment. The pressing device 10 includes a work head 12 having a work head body 14 holding a tool 16. The work head 12 includes a mating end 18 opposite to a head end 20. The pressing device 10 also includes and actuator 22 having an actuator body 24 holding a hydraulic pump 26 (shown in phantom) that is operable to drive the tool 16. The actuator 22 has a mating end 28. The pressing device includes an interconnect assembly 30 having a hydraulic hose 31 having first and second couplings 32, 34 at opposite ends 36, 38 of the hydraulic hose 31 for mating with the mating ends 18, 28 of the work head 12 and the actuator 22, respectively. The interconnect assembly 30 is removable so that the work head 12 may be directly coupled to the actuator 22. With the interconnect assembly 30 being removable, the pressing device 10 may be used for different applications as either a single unit or as a two-piece design.

The work head 12 includes the tool 16 at the head end 20. Optionally, the tool 16 may be a separate component from the work head body 14 that may be coupled to the work head body 14. For example, the tool 16 may include a tool holder 40 having fixed tooling 42 and movable tooling 44 that is movable with respect to the fixed tooling 42. Optionally, the tool holder 40 may have a pair of tooling that are both movable toward one another. The tool holder 40 may be coupled to the work head body 14 such as by a threaded connection. In the illustrated embodiment, the fixed and movable tooling 42, 44 represents crimping tooling for crimping a terminal to an end of a wire. Other types of tooling may be used in alternative embodiments, such as cutting tooling. The fixed and/or movable tooling 42, 44 may be removed from the tool holder 40 for replacing damaged tooling and/or for replacing the tooling with different sized and/or shaped tooling.

The work head body 14 is generally cylindrical in shape, however the work head body 14 may have other shapes in alternative embodiments. The work head body 14 extends along a longitudinal axis 46 extending between the mating end 18 and the head end 20. Optionally, the movable tooling 44 may be moved in a direction generally along the longitudinal axis 46 during operation.

In an exemplary embodiment, an operation switch 48 may be provided on an outer surface of the work head body 14. The operation switch 48 controls the operation of the pressing device 10. For example, the operation switch 48 may be moved between an ON position and an OFF position, wherein the movable tooling 44 is driven towards the fixed tooling 42 when the operation switch 48 is moved to the ON position. The work head 12 includes an electrical connector 50 electrically connected to the operation switch 48 for transmitting signals relating to the position of the operation switch 48 to the actuator 22.

The actuator 22 includes the hydraulic pump 26 within the actuator body 24. The hydraulic pump 26 is operatively connected to a power source 52 at a base end 54. The power source 52 may be provided in a position other than at the base end 54 in alternative embodiments. Optionally, the power source 52 may be a battery. Alternatively, the power source 52 may be an AC power source with a cord extending from the base end 54 of the actuator 22. The hydraulic pump 26 forms part of a hydraulic circuit that is used to actuate the tool 16. Optionally, the hydraulic pump 26 may move hydraulic fluid through the system without the use of an accumulator. In an exemplary embodiment, the pressing device 10 is an electrohydraulic pressing device wherein the hydraulic pump 26 is controlled by an electric motor that is powered by the power source 52.

The actuator body 24 is generally cylindrical in shape, however the actuator body 24 may have other shapes in alternative embodiments. For example, the shape of the actuator body 24 may be contoured to fit within an operator's hand. The actuator body 24 may be angled to balance or otherwise distribute the weight of the actuator body 24. The actuator body 24 may extend along a longitudinal axis 56 extending between the mating end 28 and the base end 54.

In an exemplary embodiment, a mounting element 57 is provided on the actuator body 24. The mounting element 57 may extend from the actuator body 24. Optionally, the mounting element 57 may be integrally formed with the actuator body 24. The mounting element 57 may take any shape, and in the illustrated embodiment the mounting element 57 is generally C-shaped, forming a space between the mounting element 57 and the actuator body 24. The corresponding mounting component may cooperate with the mounting element 57 for securing the actuator body 24 to the user, such that the user does not heed to hold the actuator body 24 in the user's hand during operation. For example, the mounting element 57 may be configured to secure the actuator body 24 to the user, such as on the user's hip. In an exemplary embodiment, a user's belt may extend through the space defined by the mounting element 57 to secure the actuator body 24 to the user's hip. The actuator body 24 may be secured at another location of the user in alternative embodiments. Additionally, a device other than a belt may work in conjunction with the mounting element 57 to secure the actuator body 24 to the user, such as a clip.

A pressure release 58 may be provided on the actuator body 24 for releasing the hydraulic pressure created by the hydraulic pump 26, such as to release the movable, tooling 44 in normal operation and/or in an emergency situation. The pressure release 58 may be a mechanical release or alternatively an electrical switch that controls a valve or reverses the flow of fluid in the hydraulic pump 26.

The actuator 22 includes an electrical connector 60 electrically connected to the operation switch 48. For example, when the interconnect assembly 30 is provided between the actuator 22 and the work head 12, a cable 62 having electrical connectors 64, 66 at the ends thereof extends between the electrical connector 60 of the actuator 22 and the electrical connector 50 of the work head 12. The cable 62 may be secured to the hydraulic hose 31 such as by using fasteners 68, such as wire ties. Alternatively, when the interconnect assembly 30 is removed from the work head 12 and the work head 12 is directly coupled to the actuator 22, the electrical connector 60 of the actuator 22 may be directly connected to the electrical connector 50 of the work head 12. The electrical connector 60 is electrically connected to the electric motor that operates the hydraulic pump 26. As such, the operation switch 48 is used to control the operation of the hydraulic pump 26.

Figure 2:
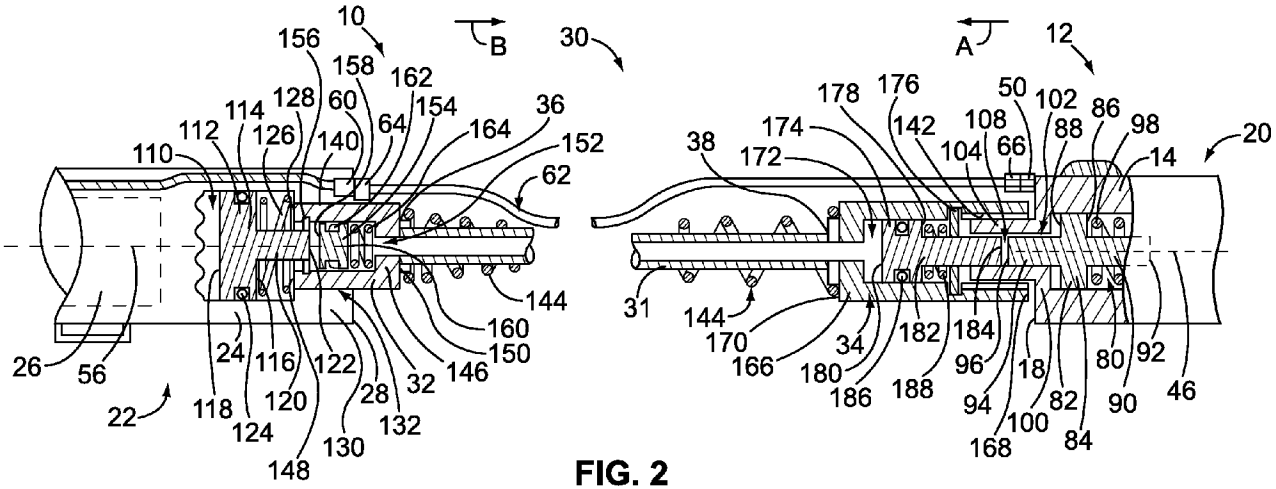
FIG. 2 is a partial cross-sectional view of the pressing device shown in FIG. 1 utilizing an interconnect assembly.

FIG. 2 is a partial cross-sectional view of the pressing device 10 utilizing the interconnect assembly 30. The work head body 14 includes a chamber 80 extending along the longitudinal axis 46 proximate to the mating end 18. A work head piston 82 is received in the chamber 80 and is movable therein. The work head piston 82 includes a main body 84 having a front end 86 and a rear end 88. The rear end 88 generally faces the mating end 18 of the work head 12, and the front end 86 generally faces the head end 20. A front rod 90 extends from the front end 86 of the main body 84 to a front abutment face 92. A rear rod 94 extends from the rear end 88 of the main body 84 to a rear abutment face 96. The main body 84 has a larger diameter than the front and rear rods 90, 94. Optionally, the front and rear rods 90, 94 may have substantially similar diameters. The work head piston 82 may have a different shape and/or features in alternative embodiments, and the work head piston 82 illustrated in FIG. 2 is merely illustrative of an exemplary embodiment of a piston for use with the work head 12. Optionally, the work head piston 82 may not include the front rod 90 and/or the rear rod 94.

A bias spring 98 engages the front end 86 and surrounds the front rod 90. The bias spring 98 generally forces the work head piston 82 in a released direction, shown in FIG. 2 by the arrow A, that is generally in a rearward direction along the longitudinal axis 46.

The work head body 14 has an end wall 100 at the mating end 18. A port 102 extends through the end wall 100 to provide access to the chamber 80 through the mating end 18. Optionally, a boss 104 extends rearwardly from the mating end 18. The boss 104 has a diameter that is smaller than the diameter of the work head body 14. Optionally, an outer surface of the boss 104 may be threaded. A bore 108 extends through the boss 104 to the port 102 and the bore 108 provides access to the port 102. The boss 104 defines a mating interface for mating with the second coupling 34 of the hydraulic hose 31 in one configuration and the actuator body 24, in another configuration. It is realized that the work head 12 may have a different mating interface for mating with the second coupling 34 and the actuator body 24 in alternative embodiments, and the work head 12 may not include the boss 104. The boss 104 may be integrally formed with the work head body 14 and may merely be an extension of the work head body 14. Alternatively, the boss 104 may be separate from the work head body 14 and may be coupled to the work head body 14 to define a mating component for the hydraulic hose 31 and the actuator 22. In an exemplary embodiment, the electrical connector 50 is provided at the end wall 100 proximate to the boss 104. The electrical connector 50 may be rearward facing for mating with the electrical connector 66 of the cable 62 or the electrical connector 60. Alternatively, the electrical connector 50 may be positioned elsewhere on the work head body 14.

The actuator body 24 includes a chamber 110 extending along the longitudinal axis 56 proximate to the mating end 28. An actuator piston 112 is received in the chamber 110 and is movable therein. In operation, the chamber 110 is filled with hydraulic fluid by the hydraulic pump 26 (shown in FIG. 1). The hydraulic fluid is configured to drive the actuator piston 112 in a pressing direction, shown in FIG. 2 by an arrow B, which is generally in a forward direction along the longitudinal axis 56.

The actuator piston 112 includes a main body 114 having a front end 116 and a rear end 118. The front end 116 generally faces the mating end 28 of the actuator 22, and the rear end 118 generally faces the base end 54 (shown in FIG. 1). A front rod 120 extends from the front end 116 of the main body 114 to a front abutment face 122. The main body 114 has a larger diameter than the front rod 120. Optionally, a seal 124 may circumferentially surround the main body 114 to provide sealing engagement with the inner walls defining the chamber 110. The actuator piston 112 may have a different shape and/or features in alternative embodiments, and the actuator piston 112 illustrated in FIG. 2 is merely illustrative of an exemplary embodiment of a piston for use with the actuator 22.

A bias spring 126 engages the front end 116 and surrounds the front rod 120. The bias, spring 126 generally forces the actuator piston 112 in a released direction, shown in FIG. 2 by the arrow A, that is generally in a rearward direction along the longitudinal axis 56. The opposite end of the bias spring 126 engages a shoulder 128 formed in the chamber 110.

The actuator body 24 has an end wall 130 at the mating end 28. A port 132 extends through the end wall 130 to provide access to the chamber 110 through the mating end 28. The port 132 has an internal diameter configured to receive either the first coupling 32 or the boss 104. Optionally, an inner surface of the port 132 may be threaded. At least a portion of the actuator piston 112 is configured to pass into and/or through the port 132 as the hydraulic fluid drives the actuator piston 112 in the pressing direction. Optionally, the port 132 may be elongated and generally define a bore through the end wall 130. The port 132 defines a mating interface for mating with the first coupling 32 of the hydraulic hose 31 in one configuration and the work head body 14 in another configuration. For example, the port 132 may generally define a receptacle for receiving the boss 104 or the first coupling 32. It is realized that the actuator 22 may have a different mating interface for mating with the first coupling 32 and the work head body 14 in alternative embodiments. For example, rather than defining a receptacle, the actuator 22 may include a boss that extends from the mating end 28. Optionally, the actuator 22 may include a connector or fitting for mating engagement with the coupling 32 of the hydraulic hose 31 or the work head 12.

In an exemplary embodiment, the electrical connector 60 is provided at the end wall 130 proximate to the port 132. The electrical connector 60 may be forward facing for mating with the electrical connector 64 of the cable 62 or the electrical connector 50 of the work head 12. Alternatively, the electrical connector 60 may be positioned elsewhere on the actuator body 24.

The hydraulic hose 31 is illustrated as being coupled to both the work head 12 and the actuator 22. The first coupling 32 is received within the port 132 of the actuator 22 and securely coupled thereto. For example, an external surface 140 of the first coupling 32 may be threaded for threaded engagement with the internal surface of the port 132. Similarly, the second coupling 34 surrounds the boss 104 of the work head 12 and is securely coupled thereto. For example, an internal surface 142 of the second coupling 34 may be threaded for threaded engagement with the external surface of the boss 104. Alternatively, rather than threaded coupling, the first and second couplings 32, 34 may be coupled to the actuator 22 and the work head 12 by different fastening means, such as by a quick-connect type of connection or by using a fastener such as a screw, a pin, a latch, and the like.

The hydraulic hose 31 has an internal channel extending between the first and second ends 36, 38 that is filled with hydraulic fluid. In an exemplary embodiment, the hydraulic hose 31 is a flexible hose and includes a strain relief 144 at each of the first and second ends 36, 38 where the flexible hose is connected to the first and second couplings 32, 34.

The first coupling 32 includes a coupling body 146 having a front end 148 and a rear end 150. The flexible hose is coupled to the first coupling 32 at the rear end 150. The coupling body 146 defines a cavity extending between the front and rear ends 148, 150. The cavity 152 is open at the front and rear ends 148, 150. A first captured piston 154 is received in the cavity 152 and held therein by a retaining ring 156 proximate to the front end 148. The first captured piston 154 includes a front end 158 and a rear end 160. Optionally, a seal 162 may extend circumferentially around the first captured piston 154 to create a seal with the walls of the coupling body 146 defining the cavity 152. The seal 162 prevents the hydraulic fluid within the hydraulic hose 31 from leaking from the first coupling 32.

In an exemplary embodiment, a bias spring 164 is provided between the first captured piston 154 and the wall of the coupling body 146 defining the rear end 150. The bias spring 164 generally forces the first captured piston 154 in a released direction, shown in FIG. 2 by the arrow A, that is generally in a rearward direction along the longitudinal axis 56. The bias spring 164 holds the first captured piston 154 away from the rear end 150 of the coupling body 146; A volume of hydraulic fluid fills the cavity 152 between the first captured piston 154 and the second captured piston 174.

In operation, the actuator piston 112 is forced in the pressing direction by hydraulic fluid that fills the chamber 110 as the hydraulic pump 26 is operated. As the actuator piston 112 is forced in the pressing direction, the front rod 120 extends into the cavity 152 of the coupling body 146 and engages the first captured piston 154. The front rod 120 passes through the retaining ring 156. The front abutment face 122 of the actuator piston 112 engages the rear end 158 of the first captured piston 154 to drive the first captured piston 154 in the pressing direction. As the first captured piston 154 is driven towards the rear end 150 of the coupling body 146, the hydraulic fluid within the cavity 152 is forced through an opening in the rear end 150 of the coupling body 146 and into the flexible hose the hydraulic hose 31.

The second coupling 34 includes a coupling body 166 having a front end 168 and a rear end 170. The flexible hose is coupled to the second coupling 34 at the fear end 170. The coupling body 166 defines a cavity 172 extending between the front and rear ends 168, 170. A second captured piston 174 is received in the cavity 172 and is held therein by a retaining ring 176 proximate to the front end 168. The second captured piston 174 includes a front end 178 and a rear end 180. Optionally, the second captured piston 174 may include a front rod 182 extending forwardly from the front end 178. The front rod 182 includes a front abutment face 184. The front rod 182 may extend through the retaining ring 176. Optionally, the front rod 182 may be aligned with the boss 104 and extend into the bore 108 of the boss 104.

A seal 186 may extend circumferentially around the second captured piston 174 to create a seal with the walls of the coupling body 166 defining the cavity 172. The seal 186 prevents the hydraulic fluid within the hydraulic hose 31 from leaking from the second coupling 34. In an exemplary embodiment, a bias spring 188 is provided between the second captured piston 174 and the retaining ring 176. The bias spring 188 generally forces the second captured piston 174 in a released direction, shown in FIG. 2 by the arrow A, that is generally in a rearward direction along the longitudinal axis 46.

In operation, when the first captured piston 154 is moved in the pressing direction, hydraulic fluid is forced through the flexible hose into the cavity 172 of the second coupling 34. The hydraulic fluid forces the second captured piston 174 in the pressing direction. As the second captured piston 174 is moved in the pressing direction, the front abutment face 184 of the second captured piston 174 engages the rear abutment face 96 of the work head piston 82. The second captured piston 174 thus drives the work head piston 82 in the pressing direction.

In an exemplary embodiment, once the hydraulic hose 31 is coupled to the actuator 22 and the work head 12, the cables 62 may be connected to the electrical connectors 50, 60. For example, the electrical connectors 64, 66 at the ends of the cable 62 may be mated with the electrical connectors 50, 60. Alternatively, the electrical connectors 64, 66 may be mated with the electrical connectors 50; 60 while the first and second couplings 32, 34 are mated to the actuator 22 and the work head 12, respectively. As such, the electrical and hydraulic connections may be made simultaneously. Similarly, the hydraulic hose 31 and the cable 62 may be uncoupled from the actuator 22 and the work head 12 and be removed from the system. Optionally, the hydraulic pump 26 may move hydraulic fluid through the system without the use of an accumulator. Optionally, the only valve between the hydraulic pump and the work head may be a check valve (not shown). The check valve may be provided in one of the actuator 22, the interconnect assembly 30 or the work head 12.

Figure 3:
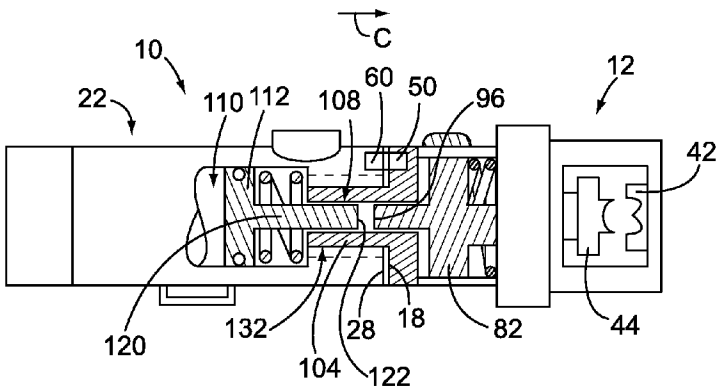
FIG. 3 is a partial cross-sectional view of the pressing device with the interconnect assembly removed.

FIG. 3 is a partial cross-sectional view of the pressing device 10 with the interconnect assembly 30 removed. FIG. 3 illustrates the work head 12 directly connected to the actuator 22. The mating ends 18, 28 are mated together. In an exemplary embodiment, the boss 104 is loaded into and/or engages the port 132. Optionally, the external surface of the boss 104 is threaded and the internal surface of the port 132 is threaded such that the work head 12 may be threadably coupled to the actuator 22. Alternatively, rather than a threaded coupling, the work head 12 may be coupled to the actuator 22 by different fastening means, such as by a quick-connect type of connection or by using a fastener such as a screw, a pin, a latch, and the like. In an exemplary embodiment, when the work head 12 is coupled to the actuator 22, the electrical connector 50 of the work head 12 is directly connected to the electrical connector 60 of the actuator 22. Optionally, at least one of the electrical connectors 50, 60 may be a Pogo-style pin that may be compressed or pushed inward during mating of the work head 12 with the actuator 22. Such electrical connectors, and other types of like connectors, may be mated during mating of the work head 12 with the actuator 22. Alternatively, a separate, intermediate electrical connector (not shown) may be provided between the electrical connectors 50, 60. The intermediate electrical connector may have a rigid body, or alternatively may be a cable with connectors at the ends and may be mated with the electrical connectors 50, 60 after the work head 12 is mated with the actuator 22.

When assembled, the actuator piston 112 is at least partially received in the bore 108 of the boss 104. For example, the front rod 120 of the actuator piston 112 may extend at least partially into the bore 108. During operation, as the chamber 110 is filled with hydraulic fluid, the actuator piston 112 is driven in the pressing direction, shown in FIG. 3 by the arrow C. As the actuator piston 112 is driven, the front abutment face 122 of the actuator piston 112 directly engages the rear abutment face 96 of the work head piston 82 to drive the work head piston in the pressing direction. The work head piston 82 is operatively coupled to the movable tooling 44 to drive the movable tooling 44 in the pressing direction towards the fixed tooling 42. Once the pressing operation is complete, the movable tooling 44 may be returned to a released position.

Figure 4:
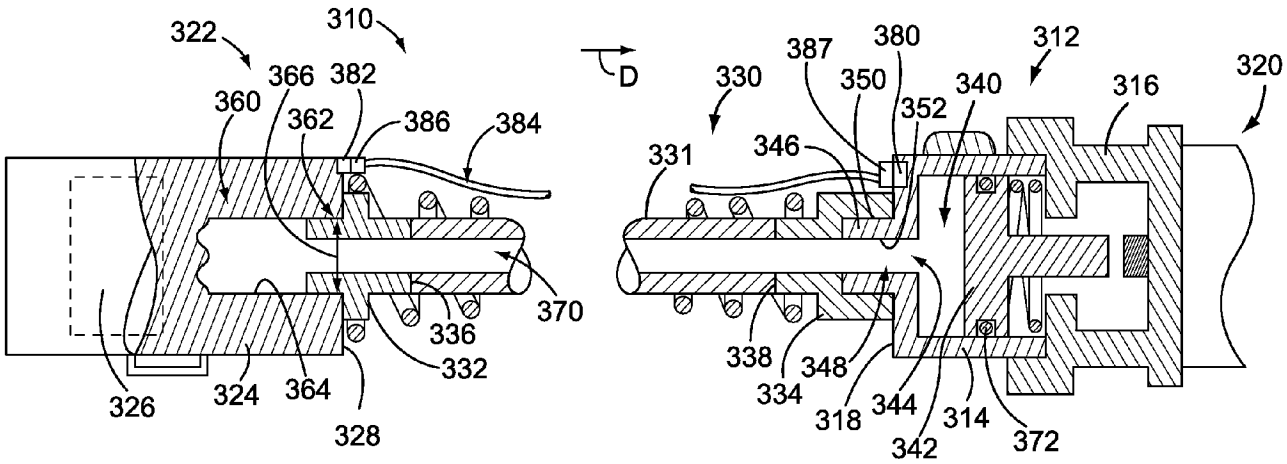
FIG. 4 is a partial cross-sectional view of an alternative electrohydraulic pressing device utilizing an interconnect assembly.

FIG. 4 is a partial cross-sectional view of an alternative electrohydraulic pressing device 310 utilizing an interconnect assembly 330. The pressing device 310 includes a work head 312 having a work head body 314 holding a tool 316. The work head 312 includes a mating end 318 opposite to a head end 320. The pressing device 310 also includes an actuator 322 having an actuator body 324 holding a hydraulic pump 326 (shown in phantom) that is operable to drive the tool 316. In an exemplary embodiment, the pump 326 provides pressurized fluid without the help of art accumulator. The actuator 322 has a mating end 328. The interconnect assembly 330 includes a hydraulic hose 331 having first and second couplings 332, 334 at opposite ends 336, 338 of the hydraulic hose 331 for mating with the mating ends 328, 318 of the actuator 322 and the work head 312, respectively. The interconnect assembly 330 is removable so that the work head 312 may be directly coupled to the actuator 322.

The work head body 314 includes a chamber 340 holding a work head piston 342. The work head body 314 includes a port 344 at the mating end 318 opening to the chamber 340. Optionally, the work head body 314 may include a boss 346 at the mating end 318 having a bore 348 providing access to the port 344. The boss 346 has an external surface 350 and an internal surface 352 defining the bore 348. Optionally, at least one of the external and internal surfaces 350, 352 may be threaded.

The actuator body 324 includes a chamber 360 and ah opening 362 through the actuator body 324 at the mating end 328 that provides access to the chamber 360. The opening 362 is defined by an internal surface 364 having a diameter 366. The actuator pump 326 is configured to deliver hydraulic fluid into the chamber 360 during operation. In an exemplary embodiment, a check valve (not shown) is provided between the pump 326 and the chamber 360 in order to maintain system pressure during the pump's suction.

The hydraulic hose 331 has an internal channel 370 that is configured to be filled with hydraulic fluid. The hydraulic hose 331 is coupled to the actuator 322 and the work head 312. For example, the first coupling 332 is coupled to the actuator 322 and second coupling 334 is coupled to the work head 312. The first coupling 332 is at least partially received in the opening 362 in the actuator body 324. Optionally, the first coupling 332 may be threadably coupled to the actuator body 324. The first coupling 332 may be coupled to the actuator 322 by an alternative fastening means in alternative embodiments. The second coupling 334 may receive the boss 346 of the work head 312. Alternatively, the second coupling 334 may be at least partially received in the bore 348. Optionally, the second coupling 334 may be threadably coupled to the work head body 314. The second coupling 334 may be coupled to the work head 312 by an alternative fastening means in alternative embodiments.

Once assembled, the hydraulic hose 331 provides a link between the actuator 322 and the work head 312. The hydraulic fluid from the hydraulic pump 326 fills the chamber 360, the internal channel 370 and at least a portion of the chamber 340 of the work head 312. The hydraulic fluid is configured to flow from the chamber 360 of the actuator 322 through the opening 362 in the first coupling 332 into the internal channel 370. The hydraulic fluid is similarly configured to flow from the internal channel 370 through the second coupling 334 and into the boss 346. The hydraulic fluid engages the work head piston 342 and drives the work head piston 342 in the pressing direction, shown in FIG. 4 by the arrow D. The work head piston 342 in turn drives the tool 316. Optionally, a seal 372 may circumferentially surround the work head piston 342 to create a seal with the walls defining the chamber 340.

In an exemplary embodiment, the work head 312 includes an electrical connector 380, and the actuator 322 includes an electrical connector 382. The electrical connectors 380, 382 are connected by a cable 384 having electrical connectors 386, 387 at the ends thereof. The electrical and hydraulic connections between the work head 312 and the actuator 322 are made by the hydraulic hose 331 and the cable 384. The hydraulic hose 331 and the cable 384 may be uncoupled from the actuator 322 and the work head 312 and be removed from the system.

Figure 5:
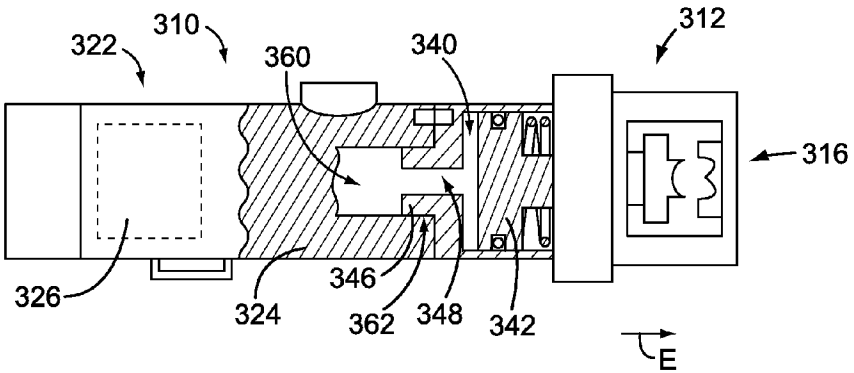
FIG. 5 is a partial cross-sectional view of the pressing device shown in FIG. 4 with the interconnect assembly removed.

FIG. 5 is a partial cross-sectional view of the pressing device 310 with the interconnect assembly 330 (shown in FIG. 4) removed. FIG. 5 illustrates the work head 312 directly coupled to the actuator 322. The boss 346 of the work head 312 is engaged in the opening 362 in the actuator body 324. The bore 348 through the boss 346 creates a flow path between the chamber 360 of the actuator 322 in the chamber 340 of the work head 312. During operation, as the hydraulic pump 326 is operated, hydraulic fluid fills the chamber 360 and is forced through the bore 348 into the chamber 340. The hydraulic fluid drives the work head piston 342 in the pressing direction, shown in FIG. 5 by the arrow E. The work head piston 342 in turn drives the tool 316.

Figure 6:
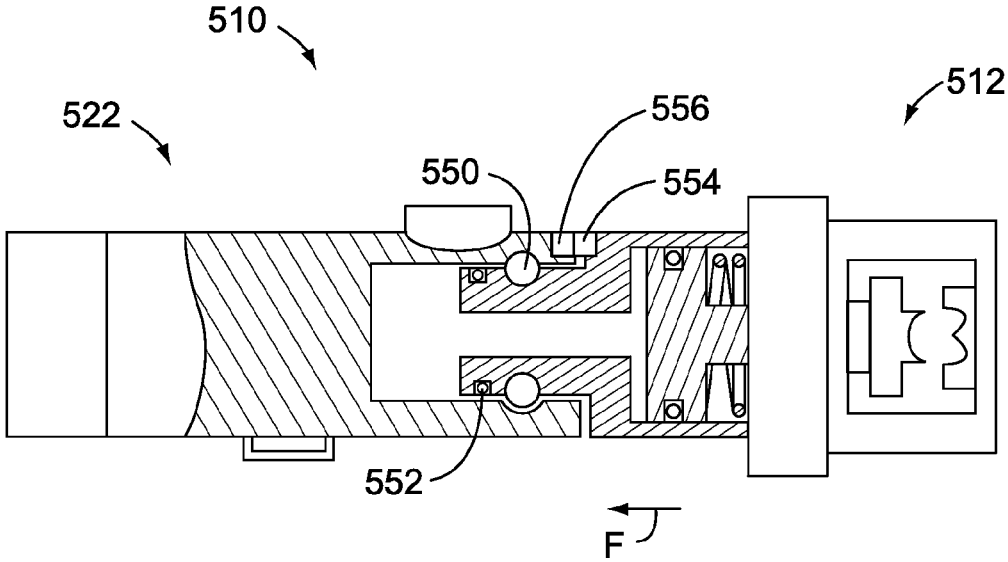
FIG. 6 is a partial cross-sectional view of another electrohydraulic pressing device showing an alternative mating connection.

FIG. 6 is a partial cross-sectional view of another electrohydraulic pressing device 510 showing an alternative mating connection. FIG. 6 illustrates a work head 512 of the pressing device 510 directly coupled to an actuator 522 of the pressing device 510. The pressing device 510 is similar to the pressing device 310 shown in FIGS. 4 and 5. However, rather than using a threaded connection, the pressing device 510 utilizes mounting pins 550 to secure the work head 512 to the actuator 522. Other types of fasteners or securing elements may be utilized in alternative embodiments. Optionally, a seal 552 may be provided between the work head 512 and the actuator 522 to prevent leakage of hydraulic fluid.

The work head 512 includes an electrical connector 554, and the actuator 522 includes an electrical connector 556. During assembly, the work head 512 is mated with the actuator 522 in a linear mating direction, shown in FIG. 6 by the arrow F, as opposed to rotating direction as is the case with a threaded connection. Because the work head 512 is mated with the actuator 522 in a linear mating direction, the electrical connectors 554, 556 may be directly plugged into one another.

Figure 7:
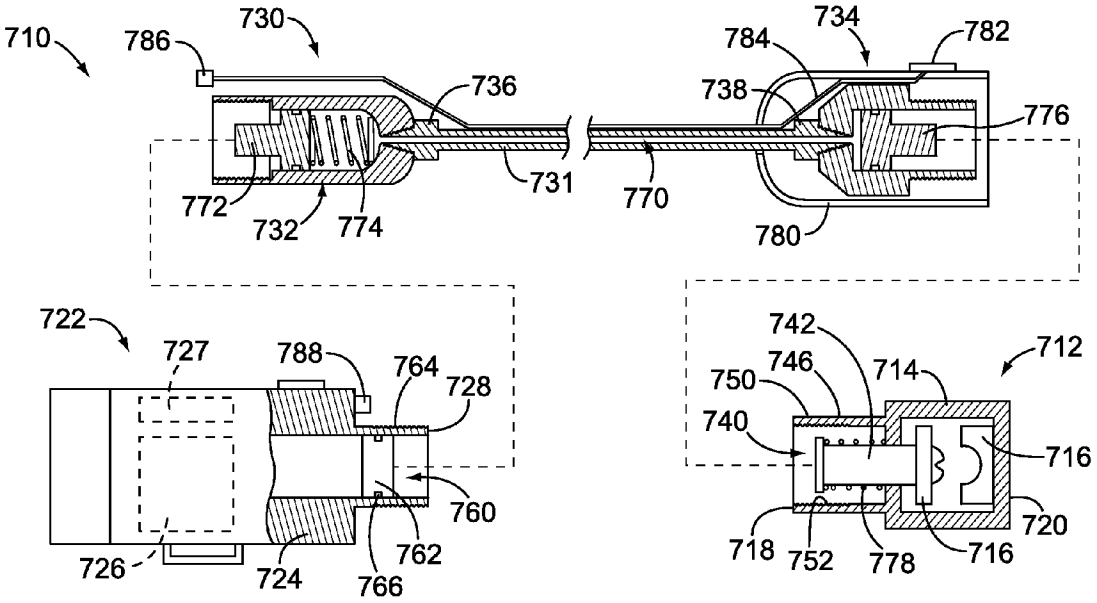
FIG. 7 is a partial cross-sectional view of another alternative electrohydraulic pressing device utilizing an interconnect assembly.

FIG. 7 is a partial cross-sectional view of another alternative electrohydraulic pressing device 710 utilizing an interconnect assembly 730. The pressing device 710 includes a work head 712 having a work head body 714 holding tooling 716. In the illustrated embodiment, the work head 712 represents a tool, similar to the tool 16 (shown in FIG. 1), which may be used without the holder structure illustrated in the embodiment of FIG. 1. The work head 712 includes a mating end 718 opposite to a head end 720. The pressing device 710 also includes an actuator 722 having an actuator body 724 holding a hydraulic pump 726 (shown in phantom) that is operable to drive the work head 712. The hydraulic pump 726 draws hydraulic fluid from a fluid reservoir 727. The actuator 722 has a mating end 728.

The interconnect assembly 730 includes a hydraulic hose 731 having first and second couplings 732, 734 at opposite ends 736, 738 of the hydraulic hose 731 for mating with the mating ends 728, 718 of the actuator 722 and the work head 712, respectively. The interconnect assembly 730 is removable so that the work head 712 may be directly coupled to the actuator 722.

The work head body 714 includes a chamber 740 holding a work head piston 742. In the illustrated embodiment, the work head piston 742 directly engages the tool 716. Optionally, the work head piston 742 may be integrally formed with the tool 716. Alternatively, the work head piston 742 may indirectly drive the tool 716, such as by positioning another component between the work head piston 742 and the tool 716. Optionally, the work head body 714 may include a boss 746 at the mating end 718. The boss 746 has an external surface 750 and an internal surface 752 defining the chamber 740. Optionally, at least one of the external and internal surfaces 750, 752 may be threaded.

The actuator body 724 includes a chamber 760 and an actuator piston 762 positioned within the chamber 760. In the illustrated embodiment, an outer surface 764 of the actuator body 724 at the mating end 728 is threaded. The actuator pump 726 is configured to deliver hydraulic fluid into the chamber 760 during operation. A seal 766 surrounds the actuator piston 762 to hold the hydraulic fluid within the chamber 760 behind the actuator piston 762.

The hydraulic hose 731 has an internal channel 770 that is filled with hydraulic fluid. The hydraulic hose 731 is coupled to the actuator 722 and the work head 712. For example, the first coupling 732 is coupled to the actuator 722 and second coupling 734 is coupled to the work head 712. In an exemplary embodiment, the first coupling 732 is threadably coupled to the actuator body 724. The first coupling 732 may be coupled to the actuator 722 by an alternative fastening means in alternative embodiments. A first coupling piston 772, held within the first coupling 732, may be at least partially received within the chamber 760. The first coupling piston 772 engages the actuator piston 762 and is driven by the actuator piston 762. A return spring 774 biases the first coupling piston 772 toward the actuator piston 762.

The second coupling 734 may receive the boss 746 of the work head 712. Optionally, the second coupling 734 may be threadably coupled to the boss 746. The second coupling 734 may be coupled to the work head 712 by an alternative fastening means in alternative embodiments. A second coupling piston 776, held within the second coupling 734, may be at least partially received within the work head body 714. The second coupling piston 776 engages the work head piston 742 and drives the work head piston 742. A return spring 778 biases the work head piston 742 toward the second coupling piston 776.

In an exemplary embodiment, a casing 780 surrounds the second coupling 734. The casing 780 is coupled to the work head 712 by the second coupling 734. Optionally, the casing 780 may constitute a hand grip for the operator to hold the work head 712. In an exemplary embodiment, an activation switch 782 is provided oh the casing 780 that may be pressed or otherwise activated by the operator to operate the pressing device 710. A cable 784 may be electrically connected to the activation switch 782. An electrical connector 786 is provided at the opposite end of the cable 784 for coupling to a corresponding electrical connector 788 on the actuator 722. Once assembled, the hydraulic hose assembly 710 provides both a hydraulic and electrical link between the actuator 722 in the work head 712. In an exemplary embodiment, the hydraulic hose 731 and the cable 784 may be uncoupled from the actuator 722 and the work head 712 and be removed from the system.

Figure 8:
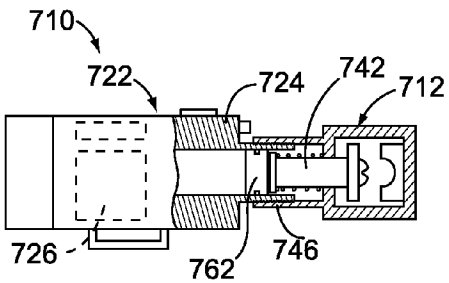
FIG. 8 is a partial cross-sectional view of the pressing device shown in FIG. 7 with the interconnect assembly removed.

FIG. 8 is a partial cross-sectional view of the pressing device 710 with the interconnect assembly 730 (shown in FIG. 7) removed. FIG. 8 illustrates the work head 712 directly coupled to the actuator 722. The boss 746 of the work head 712 surrounds a portion of the actuator body 724 and is coupled thereto. For example, the work head 712 may be threadably coupled to the actuator 722. The work head piston 742 engages the actuator piston 762 and is driven by the actuator piston 762. The actuator 722 includes an activation switch 790 for activating the hydraulic pump 726. Optionally, when the interconnect assembly 730 is utilized, the activation switch 790 may be disabled such that the activation switch 782 controls the operation of the pressing device 710. Alternatively, either switch may be used to activate the hydraulic pump 726.

A pressing device is thus provided that may be utilized in a wide range of applications. The pressing device includes a work head and an actuator that may be connected with one another either directly or indirectly with a hydraulic hose therebetween. The hydraulic hose is removable to allow for the direct connection between the work head and the actuator to create a more compact pressing device. With the hydraulic hose connected between the work head, and the actuator, the actuator may be held and/of positioned separately from the work head. An operator may thus hold the work head in one hand while the actuator is positioned on the ground near the operator or held by the operator with a strap or on a belt. As such, the operator is able to hold the work head with one hand, which provides a lighter, more maneuverable pressing device. In an exemplary embodiment, the actuator may be light enough to be conveniently worn, or otherwise held by the operator, such as on the operator's hip. The work head may be substantially lighter than the actuator and may be conveniently handheld. For example, the actuator may be less than approximately 7 lbs and the work head may be less than approximately 3 lbs. The operation switch may be provided on the work head and be electrically connected to the actuator by a cable when the hydraulic hose is used. The cable may be removed in a similar fashion as the hydraulic hose. Optionally, the cable may be held internal to the interconnect assembly and may be connected and disconnected as the interconnect assembly is connected and disconnected. The work head includes a tool that is hydraulically actuated by the actuator. Different types of tools may be used, such as crimping tools cutting tools and the like. Optionally, the tool may be removed and/of replaced while utilizing the same work head body.

It is to be understood that the above description is intended to be illustrative; and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. 112, sixth paragraph, unless and until such claim limitations expressly use the phrase "means for" followed by a statement of function void of further structure.

What is claimed is:

1. A pressing device comprising:

a work head having a work head body holding a tool, the work head having a mating end;

an actuator having an actuator body holding a hydraulic pump, the hydraulic pump being operable to drive the tool, the actuator having a mating end;

an interconnect assembly including a hydraulic hose having first and second couplings at both ends of the hydraulic hose for mating with the mating ends of the actuator and the work head, respectively, wherein the interconnect assembly is removable and the mating end of the work head is configured to be directly coupled to the mating end of the actuator; and a switch on the work head body and an electrical connector on the mating end of the work head body, the switch being electrically connected to the electrical connector, the actuator includes an electrical connector, wherein the electrical connectors are configured to be mated with one another when the work head is directly coupled to the actuator body.

2. A pressing device comprising:

a work head having a work head body holding a tool, the work head having a work head piston within the work head body for driving the tool, the work head having a mating end;

an actuator having an actuator body holding a hydraulic pump, the hydraulic pump being operatively coupled to a power source, the actuator body having a chamber receiving hydraulic fluid from the hydraulic pump, the actuator having an actuator piston received in the chamber and being driven by the hydraulic fluid in the chamber, the actuator having a mating end; and an interconnect assembly including a hydraulic hose having first and second couplings at both ends for mating with the mating ends of the actuator and the work head, respectively, each coupling having a captured piston, the hydraulic hose having hydraulic fluid between the captured pistons, wherein the actuator piston drives the captured piston in the first coupling and the captured piston in the second coupling drives the work head piston;

wherein the interconnect assembly is removable and when the interconnect assembly is removed from the pressing device, the mating end of the work head is configured to be directly coupled to the mating end of the actuator such that the actuator piston drives the work head piston.

3. The pressing device of claim 2, wherein the actuator piston directly engages and drives the work head piston when the work head is directly coupled to the actuator.

4. The pressing device of claim 2, wherein the work head body includes a boss at the mating end, the boss is received in the second coupling when the interconnect assembly is coupled to the mating end, and the boss is received in the actuator body when the work head is directly coupled to the actuator.

5. The pressing device of claim 2, wherein the work head body includes a port at the mating end, the captured piston in the second coupling extends through the port to engage the work head piston when the interconnect assembly is coupled to the mating end, and the actuator piston extends through the port to engage the work head piston when the work head is directly coupled to the actuator.

6. The pressing device of claim 2, further comprising a switch on the work head body and an electrical connector on the mating end of the work head body, the switch being electrically connected to the electrical connector, the actuator includes an electrical connector, wherein the electrical connectors are configured to be mated with one another when the work head is directly coupled to the actuator body.

7. The pressing device of claim 6, wherein the interconnect assembly includes an electrical cable with electrical connectors at opposite ends thereof, the electrical connectors of the cable being mated with the electrical connectors of the actuator and the work head to electrically connect the electrical connector of the work head and the electrical connector of the actuator when the work head is coupled to the actuator by the interconnect assembly.

8. The pressing device of claim 2, wherein each of the pistons is configured to be moved in a pressing direction when the hydraulic pump is operated, and wherein bias springs push each of the pistons in a released direction generally opposite to the pressing direction.

9. The pressing device of claim 2, wherein each of the captured pistons includes a seal that retains the hydraulic fluid in the hydraulic hose.

10. The pressing device of claim 2, wherein the tool has fixed tooling and movable tooling driven by the work head piston towards the fixed tooling.

11. The pressing device of claim 1, wherein the work head includes a work head piston received within the work head body for driving the tool, and wherein the actuator includes an actuator piston received within the actuator body, the actuator piston directly engaging and driving the work head piston when the work head is directly coupled to the actuator.

12. The pressing device of claim 11, wherein each of the couplings includes a captured piston therein, wherein the actuator piston drives the captured piston in the first coupling and the captured piston in the second coupling drives the work head piston, and wherein the work head body includes a port at the mating end, the captured piston in the second coupling extends through the port to engage the work head piston when the interconnect assembly is coupled to the mating end of the work head, and the actuator piston extends through the port to engage the work head piston when the work head is directly coupled to the actuator.

13. The pressing device of claim 11, wherein each of the couplings includes a captured piston therein, wherein the actuator piston drives the captured piston in the first coupling and the captured piston in the second coupling drives the work head piston.

14. The pressing device of claim 1, wherein the work head body includes a boss at the mating end, the boss is received in the second coupling when the interconnect assembly is coupled to the mating end, and the boss is received in the actuator body when the work head is directly coupled to the actuator.

15. The pressing device of claim 1, wherein the actuator body has a chamber, the hydraulic pump fills the chamber with hydraulic fluid, the interconnect assembly being coupled to the actuator body such that the hydraulic fluid is capable of filling the hydraulic hose.

16. The pressing device of claim 1, wherein the hydraulic hose is filled with hydraulic fluid, and wherein the first and second couplings have seals to retain the hydraulic fluid within the hydraulic hose.

17. The pressing device of claim 1, wherein the actuator includes a mounting element configured to be mounted to a user in a hands free configuration.

18. The pressing device of claim 1, wherein the hydraulic pump moves hydraulic fluid directly to the work head without the use of an accumulator.

19. The pressing device of claim 1, wherein fluid passes thru only one valve between the hydraulic pump and the work head.

20. The pressing device of claim 1, wherein fluid flows from the hydraulic pump into the work head without passing through any valves except check valves.

21. The pressing device of claim 1, wherein the tool has first and second tooling, at least one of the first and second tooling being movable when the actuator is operated.

* * * * *